US006132284A

United States Patent [19]

Lin

[11] Patent Number: 6,132,284

[45] Date of Patent: Oct. 17, 2000

[54] TRANSMISSION STRUCTURE TO PROVIDE AN ORNAMENT WITH ROTARY AND SWINGING MOTION IN A WATER GLOBE

[76] Inventor: Hsi-Chun Lin, P.O. Box 96-405, Taipei 10098, Taiwan

[21] Appl. No.: 09/083,196

[22] Filed: May 22, 1998

[51] Int. Cl.[7] ..... A63H 33/26; A63H 29/22; G09F 19/02

[52] U.S. Cl. ..... 446/267; 446/133; 446/136; 40/426

[58] Field of Search ..... 446/129, 133–136, 446/267; 40/411, 415, 426

[56] References Cited

U.S. PATENT DOCUMENTS

| | | | |
|---|---|---|---|
| 5,088,218 | 2/1992 | Liu | 40/411 |
| 5,435,086 | 7/1995 | Huang | 40/426 |
| 5,456,031 | 10/1995 | Hou | 40/410 |
| 5,620,353 | 4/1997 | Lai | 446/136 |
| 5,875,577 | 3/1999 | Lu | 40/411 |
| 5,878,956 | 3/1999 | Djukastein et al. | 239/69 |

FOREIGN PATENT DOCUMENTS

| | | | |
|---|---|---|---|
| 588192 | 5/1947 | United Kingdom | 446/129 |

*Primary Examiner*—Kien T. Nguyen
*Assistant Examiner*—Laura Fossum
*Attorney, Agent, or Firm*—Dougherty & Troxell

[57] ABSTRACT

A transmission structure to provide an ornament with a rotary and swinging motion in a water globe, which mainly comprises a rotary and swinging ornament in the water globe; the bottom of the rotary and swinging ornament has a cylindrical hole having a suitable depth; the opening of the cylindrical hole is closed with a base member, of which the bottom is glued with a magnet; the hollow space of the rotary and swinging ornament is filled with water. The neck part of the water globe is fixedly mounted on a base member, of which the inner space is mounted with a music drum assembly; a rotary member is fastened on the music drum assembly; the fixed frame of the rotary member is fastened with two magnets having different polarity. The diameter of the magnets each are smaller than that of a magnet mounted in the base member on the bottom of the rotary and swinging ornament. The rotary and swinging ornament in the water globe is mounted on the base member having a spherical bottom surface; the rotary and swinging ornament is set in oblique position as a result of the attracting force between the magnet in the base member and the magnet in the rotary and swinging ornament, and when the music drum assembly drives the rotary and swinging ornament to turn circularly, the ornament will also move in a waving and turning manner.

5 Claims, 5 Drawing Sheets

TRANSMISSION STRUCTURE TO PROVIDE AN ORNAMENT WITH ROTARY AND SWINGING MOTION IN A WATER GLOBE

BACKGROUND OF THE INVENTION

1. Field of the Invention

This invention relates to a water globe, and particularly to a transmission structure to provide an ornament with rotary and swinging motion in a water globe.

2. Description of the Prior Art

In a conventional water globe with an ornament, the neck part of the glass globe is usually closed with a watertight seal; the center inner side of the watertight seal is glued with an ornament, and then the neck part of the glass globe is mounted on a base. By means of the water and the convex lens effect, the ornament in the water globe will generate an enlarged view.

In the conventional toy turn-table, the base of toy on the turn-table is usually glued with a magnet; a magnet is also glued on a rotary member under the turn-table; when the rotary member rotates, the magnet will, by means of the attracting force, drive the toy on the turntable to move.

In the conventional swinging ornament in a water globe, the swinging ornament in a glass globe is usually furnished with a transmission mechanism under the watertight seal in order to provide some motion state; the ornaments in the water globe include an artificial snowflakes or windmills, which are driven to move with a gear-transmission mechanism.

In a conventional transmission structure in the water globe, such as U.S. Pat. No. 5,620,353, the globe body thereof has a hollow space to be mounted with an ornament, of which the bottom is mounted with a magnet. The base under the water globe is furnished with a transmission mechanism, on which the arm member is fastened with two magnets. The ornament in the water globe can rotate and turn by means of the magnet under the bottom of the ornament and the magnet mounted on the tail end of the arm member to attract each other.

The arm member on the transmission mechanism of the aforesaid invention is glued with two magnets; the manufacturer of the music drum assembly has long used the aforesaid structure, and it has become a well-known assembly to be used by ornament manufacturer. The magnet on the arm member and the magnet of the ornament will generate an attracting force to cause the ornament on the turntable to move; such technique of using magnetic force is not developed by U.S. Pat. No. 5,620,353, in which the drawings has shown that the hollow ornament has a magnet mounted on the bottom of the ornament, but there is no further description on how the magnet is mounted, and about the related structure thereof.

SUMMARY OF THE INVENTION

The prime object of the present invention is to provide a transmission structure for a rotary and swinging ornament in a water globe, in which the ornament has a hollow space filled with water; the bottom center thereof has a cylindrical hole to be closed with a base member, of which the bottom is fastened with a magnet. The rotary and swinging ornament in the water globe will move upon the music drum assembly driving the rotary member to move; the rotary member is mounted with two magnets having different polarity, which can drive the rotary and swinging ornament to move circularly in a waving and turning manner.

Another object of the present invention is to provide a transmission structure for a rotary and swinging ornament in a water globe; the ornament has a hollow ornament body; the bottom thereof has a cylindrical hole to be closed with a base member; the ornament body is filled with water, and the base member is used for closing the cylindrical hole on the bottom thereof The inside of the base member is mounted with a magnet and a suitable weight so as to lower the gravity of the rotary and swinging ornament, and to have the ornament contacted with the surface of a disk always.

Still another object of the present invention is to provide a transmission structure for a rotary and swinging ornament, in which the hollow ornament body in the water globe is filled with water so as to reduce the specific gravity of the rotary and swinging ornament without floating and also to reduce the magnetic force required for driving the ornament to move.

A further object of the present invention is to provide a transmission structure for a rotary and swinging ornament, in which the base member in the cylindrical hole on the bottom of the ornament has a spherical surface to be in contact with the smooth disk in the watertight seal mounted in the neck part of the water globe.

A still further object of the present invention is to provide a transmission structure for a rotary and swinging ornament, in which the rotary member on the music drum assembly is furnished with a fixed frame fastened with two magnets having different polarity; the magnets are fixed in place with fixed claws; the magnets are separated from each other at a very close space; the magnetic force thereof is used to drive the rotary and swinging ornament to rotate and move upon the music drum assembly rotating.

Yet another object of the present invention is to provide a transmission structure for a rotary and swinging ornament, in which the base member of the cylindrical hole on the bottom of the ornament is mounted with a magnet; the diameter of the magnet is larger than that of magnet mounted on the rotary member. The two magnets on the rotary member are mounted in place with different polarity, and there is a very short space between the two magnets. The magnet on the outer edge and the magnet at the bottom of the rotary and swinging ornament are attracted each other. The bottom of the base member is substantially a spherical surface so as to provide the rotary and swinging ornament with a lower resistance upon the ornament moving in a rolling manner along the top surface of the disk.

Yet still another object of the present invention is to provide a transmission structure for a rotary and swinging ornament, in which the bottom surface of the base member is a spherical surface in contact with the top surface of the disk. When the magnet in the base member and the magnet on the outer edge of the rotary member are attracted each other, the magnet on the inner part of the rotary member will repel the magnet in the base member; as a result, the magnet in the base member will have an eccentric moving and balance effect, the magnet in the base member will have an oblique balance effect. When the rotary member drives the rotary and swinging ornament to move, the spherical surface of the base member will move in a rolling manner along the outer edge of the disk as a result of the magnet in the base member always seeking a magnetic balance and a friction coefficient; then, the ornament body on the base member will move and rotate in a waving and turning manner.

DETAILED DESCRIPTION OF THE PREFERRED EMBODIMENTS

Figure 1:
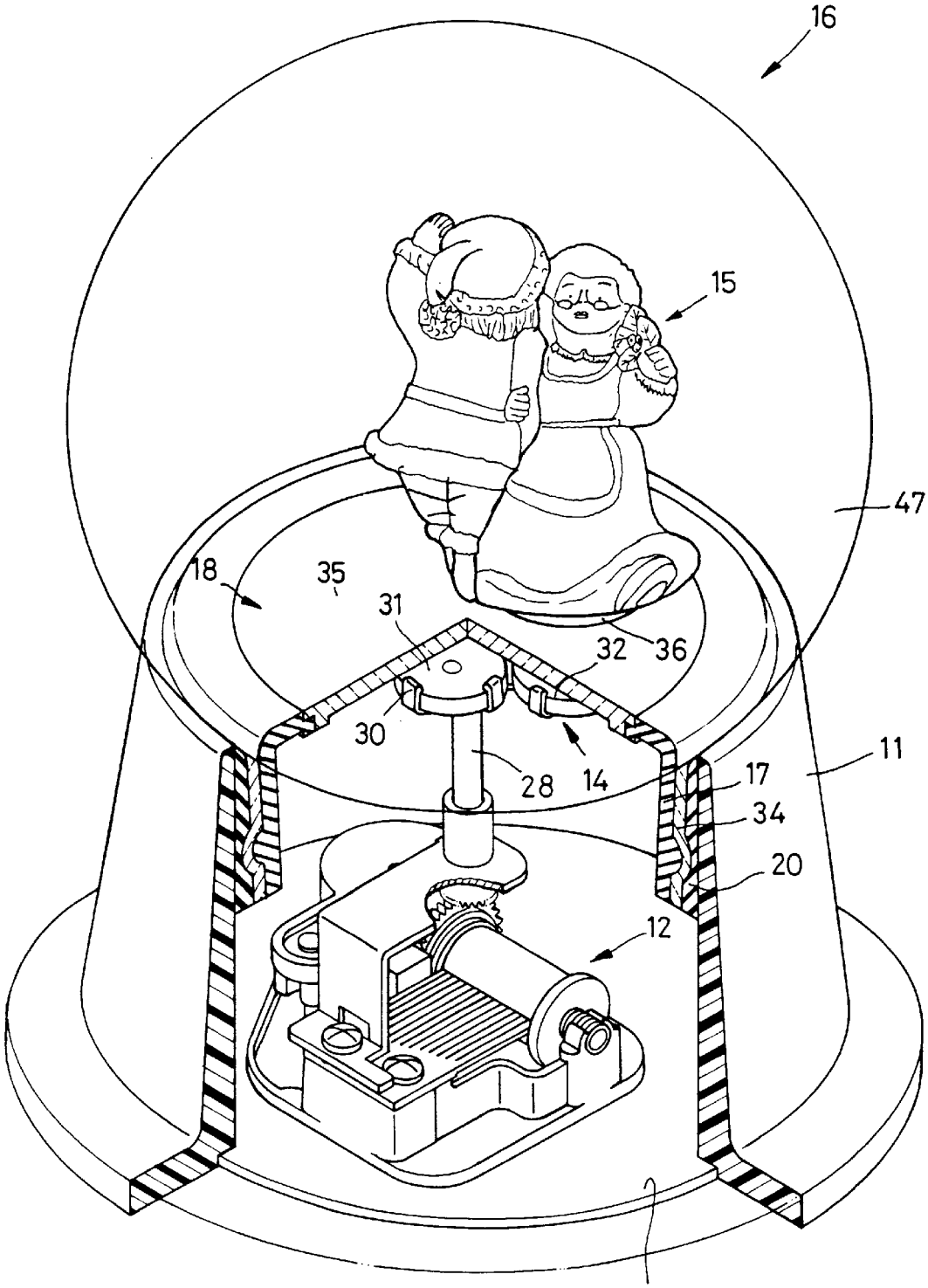
FIG. 1 is a perspective view of the present invention, showing the transmission structure of the water globe thereof.
Figure 2:
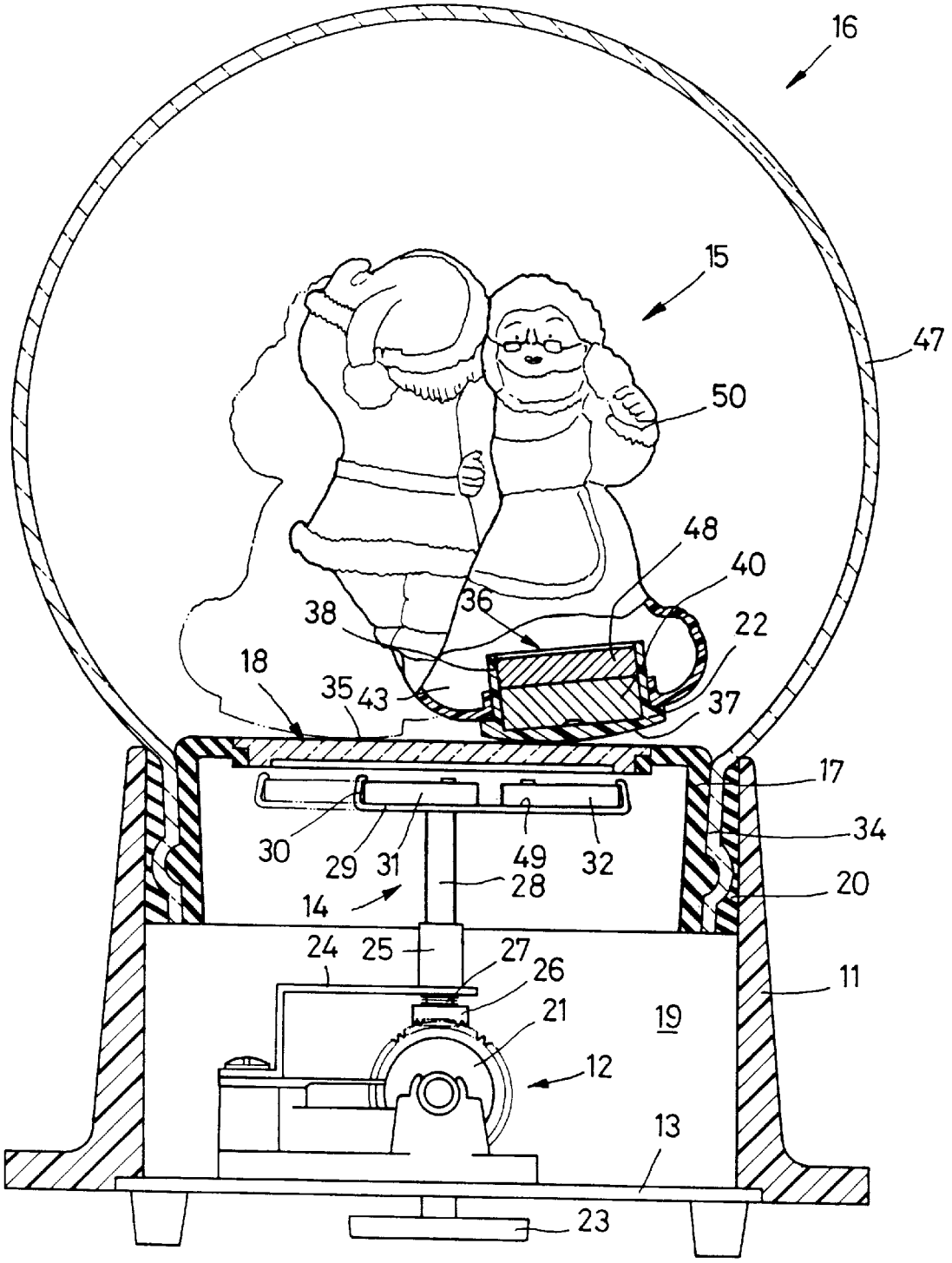
FIG. 2 is a sectional view of the present invention, showing the transmission structure of the water globe thereof.
Figure 3:
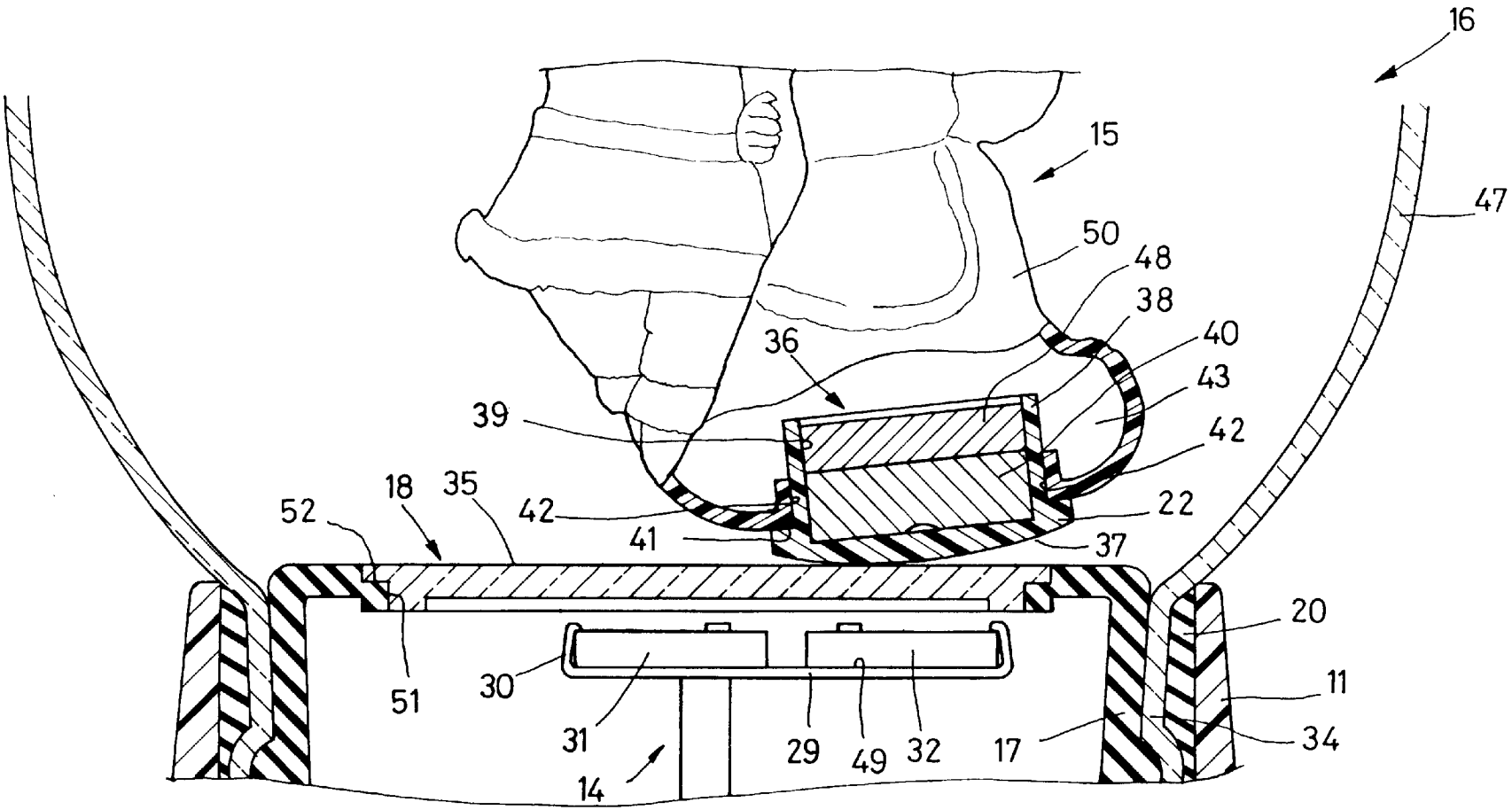
FIG. 3 is a sectional view of the present invention, showing a fragmental enlarged part as shown in FIG. 2.

Referring to FIGS. 1 to 3, the present invention relates to a transmission structure to provide an ornament with rotating and swinging motion in a water globe; the global body 47 of the water globe 16 is filled with water and a rotary and swinging ornament 15. The neck part 34 of the global body 47 is mounted with a watertight seal 17. The rotary and swinging ornament 15 in the global body 47 is a hollow body, which is filled with water; the opening thereof is closed with a base member 36, in which the hollow portion is mounted with a magnet 40. The outer surface of the neck part 34 of the global body 47 is fitted in an upper cylinder of a base member 11; a gap-seal plastics 20 is filled in a space between the neck part 34 and the upper cylinder. The inner and lower space of the base member 11 is mounted with a fixed disk 13, on which a music drum assembly 12 is fastened. The top of the music drum assembly 12 is mounted with a rotary member 14. The top of the rotary member 14 has an arm plate 49 fastened with two magnets 31 and 32, of which the polarity is arranged in opposite position. The two magnets 31 and 32 are mounted at the shortest distance from the bottom surface of the watertight seal 17. As soon as the magnets 31 and 32 on the rotary member 14 are driven to turn with the music drum assembly 12, the magnetic field formed with the two magnets 31 and 32 will cause the rotary and swinging ornament 15 in the water globe 16 to move.

The music drum assembly 12 on the base member 11 in the hollow space 19 is fastened, by means of screws, to the fixed disk 13; the assembly 12 has a knob 23 extended through and out of the fixed disk 13. The outer edge of the fixed disk 13 is fastened to the bottom of the base member 11. The transmission gear 21 of the music drum assembly 12 meshes with the rotary gear 26 of the rotary member 14. The spindle 28 of the rotary gear 26 is pivotally mounted in a spindle base 25 at one end of the positioning frame 24; a spring 27 is mounted between the bottom of the positioning frame 24 and the rotary gear 26 so as to maintain a close mesh force between the rotary gear 26 and the transmission gear 21.The upper end of the spindle 28 is furnished with a horizontal fixed frame 29 having an arm plate 49, of which both ends are provided with fixed claws 30 erected upwards respectively; within the fixed claws 30, a flat plate is formed for mounting two cylinder-shaped magnets 31 and 32 having two different polarity; the magnets are fastened in place by means of the fixed claws 30, i.e., the two magnets 3 land 32 having different polarity are fastened on the arm plate 49. The polarity of the magnets 31 and the magnet 40 under the rotary and swinging ornament 15 will repel from each other. After the magnet 31 is mounted on the arm plate 49 of the rotary member 14, the center of the magnet 31 is adjacent to the center of the spindle 28; the magnet 31 has a shorter turning radius; the polarity of the magnet 32 and the polarity of the magnet 40 under the rotary and swinging ornament 15 are attracting each other. The magnet 32 is mounted on the arm plate 49 of the rotary member 14, having a longer distance from the center of the spindle 28, i.e., having a longer turning radius. The top surface of the magnets 31 and 32 separate from the bottom surface of the watertight seal 17, and when the rotary member 14 rotates, the magnets would not touch the bottom surface of the watertight seal 17.

The spring motor of the music drum assembly 12 can be wound by turning the knob 23; the spring motor will have the music drum assembly 12 generate music, and simultaneously it will drive the spindle 28 of the rotary member 14 to rotate; then, the two magnets 31 and 32 having different polarity on the rotary member 14 will turn to cause the rotary and swinging ornament 15 in the global body 47 of the water globe 16 to turn in an up-and-down manner.

The watertight seal 17 in the neck part 34 of the global body 47 is in close contact hermetically with the inner surface of the neck part 34 of the global body 47; the center of the watertight seal 17 is glued with a disk 18, of which the top surface 35 is a smooth and flat surface so as to minimize the friction resistance upon the rotary and swinging ornament 15 moving thereon.

Figure 7:
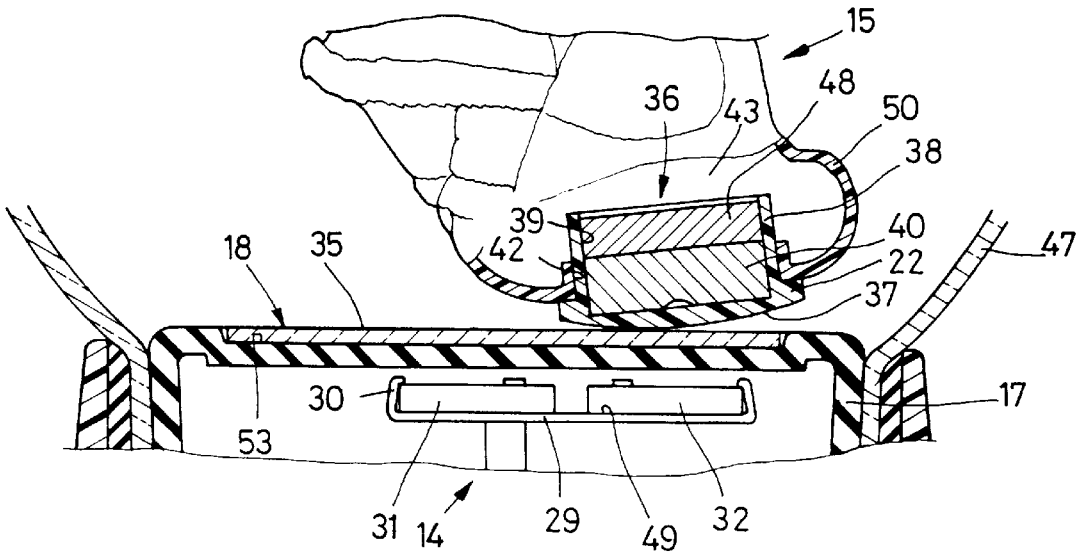
FIG. 7 is a sectional view of the present invention, showing a disk mounted on a watertight seal thereof.

The disk 18 is in contact with the base member 36 of the rotary and swinging ornament 15 in the center of the watertight seal 17 as shown in FIGS. 2 and 3; the center of the watertight seal 17 has a through cylindrical hole 51, which is furnished with a ring-shaped stair part 52 to facilitate the disk 18 having a smooth top surface 35 to glue and connect. As shown in FIG. 7, the top side of the watertight seal 17 is furnished with a recess plane 53, on which a thin disk 18 with a smooth top surface 35 is glued. The smooth top surface 35 is in contact with the base member 36 so as to minimize the friction resistance of the moving rotary and swinging ornament 15.

The rotary and swinging ornament 15 in the global body 47 of the water globe 16 includes an ornament body 50, a base member 36, a magnet 40 and a weight 48. The ornament body 50 is substantially a hollow body, of which the bottom has a cylindrical hole 42; the inside of cylindrical hole 42 is a hollow space 43 filled with water. The opening of cylindrical hole 42 is closed with the base member 36, of which the upper edge is furnished with a cylinder 38 is equal to or slightly less than that of cylindrical hole 42 under the ornament body 50 so as to facilitate the base member 36 and the cylindrical hole 42 to join together. The diameter of the inner surface 39 of cylinder 38 is larger than the diameter of magnet 31 or magnet 32 on the rotary member 14 so as to fit magnet 40 therein.

The base member 36 is fitted in the cylindrical hole 42 on the bottom of the ornament body 50. The bottom of the cylinder 38 has a ring flange 22 having a larger diameter; the inner surface of the ring flange 22 and the cylinder 38 are formed into a positioning stair part 41, with which the outer surface of the cylindrical hole 42 can be in close and tight contact with the base member 36 upon the member 36 being fitted in the cylindrical hole 42 of the ornament body 50; the aforesaid members may also be joined together hermetically by using a glue.

The base member 36 and the cylindrical hole 42 of the ornament body 50 can be joined together by means of cylinder 38; then, the bottom surface 37 of the base member 36 will be in contact with disk 18 in the center of the watertight seal 17. The disk 18 in the center of the watertight seal 17 has a smooth top surface 35, which can minimize the motion resistance of the rotary and swinging ornament 15; therefore, the bottom surface 37 of the base member 36 should be designed to have low contact resistance, i.e., being preferred spherical surface so as to have the bottom surface of the rotary and swinging ornament 15 contacted with the top surface 35 of disk 18 only on the smallest point of the spherical surface in order to minimize the friction resistance upon the rotary and swinging ornament 15 moving.

The suitable ornament body 50 is a hollow body, which is filled with water; the cylindrical hole 42 under the bottom of the ornament body 50 is loaded with the base member 36 including the magnet 40 and a weight 48, which are sealed in place to formed into the rotary and swinging ornament 15; then, the ornament 15 is put in water inside the global body 47 of water globe 16. By means of the magnet 40 and the weight 48 on the base member 36 under the ornament body 50, the rotary and swinging ornament 15 is able to stand vertically.

After the rotary and swinging ornament 15 is put in the water inside the global body 47 of water globe 16, the ornament 15 will sink to the lowest spot as a result of gravity. After the watertight seal 17 is sealed to the neck part 34 of the global body 47 of water globe 16 and to the inner wall of the base member 11, the base member 11 can be placed on the top side of a table; then, the bottom surface 37 of the rotary and swinging ornament 15 will be in contact with the disk 18 on the watertight seal 17. The hollow space 19 in the base member is installed with the music drum assembly 12 and the rotary member 14. When the music drum assembly 12 rotates to drive the rotary member to turn, the magnets 31 and 32 with different polarity on the rotary member 14 will turn at different radiuses to cause the rotary and swinging ornament 15 in the global body 47 to move circularly.

When the rotary and swinging ornament 15 in the global body 47 is in contact with the disk 18, the ornament 15 will be unable to move into the central part of the disk 18 because of the magnet 31 generating a repelling force; simultaneously, the other magnet 32 can generate an attracting force to attract the ornament 15 to move and to stand vertically along the outer surface of the disk 18.

The magnet 40 mounted on the bottom of the rotary and swinging ornament 15 has a larger diameter, and it is subject to the repelling and attracting forces of the magnets 31 and 32 respectively. The magnet 40 can balance the magnetic force between the other magnets and itself by moving automatically. The bottom surface 37 of the base member 36 mounted with magnet 40 is a spherical surface to be in contact with the disk 18. During magnet 40 moving to balance its magnetic force, the fast displacing spherical surface point would cause magnet 40 always sitting in an oblique state.

Figure 4:
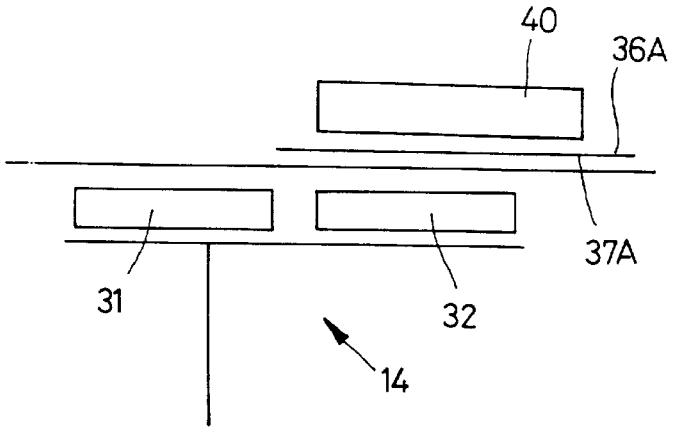
FIG. 4 is a plan view of the present invention, showing a balance state of the magnetomative force therein.
Figure 5:
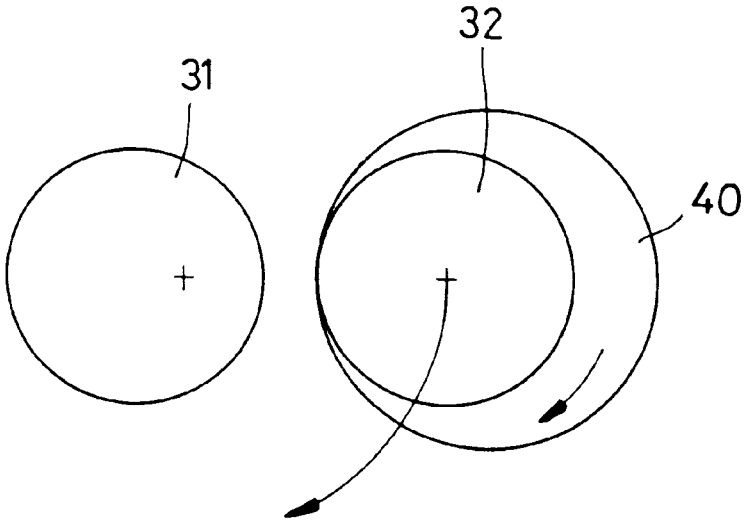
FIG. 5 is a plan view of the present invention, showing the displacement state of the magnet therein.
Figure 6:
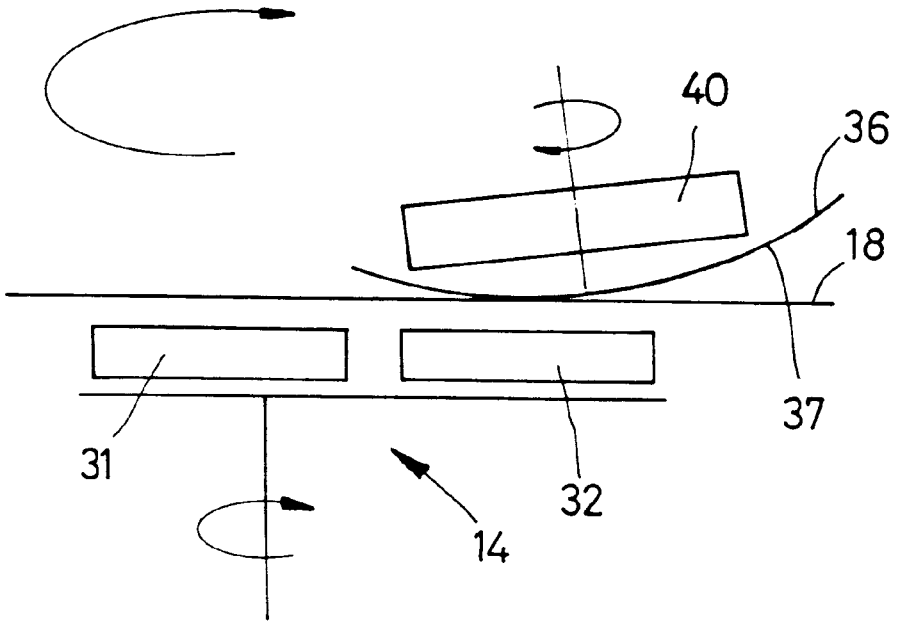
FIG. 6 is a sectional view of the present invention, showing the magnet in an oblique and balance state.

In order to have a better understanding the relation between the motion of base member 36 and the magnetic force balance, the following experiment is useful; for example, if the bottom surface 37A of the base member 36A mounted with magnet 40 is a flat surface to be in contact with the disk 18 as shown in FIG. 4, the circumference of magnet 40 and magnet 32, upon the magnet 40 displacing for balancing the magnetic force, will be in a close tangential state, i.e., the close tangent point is nearing the most adjacent point between magnet 32 and magnet 31; the bottom surface 37A of the base member 36A will be in close and flat contact with the top surface 35 of disk 18; in that case, the rotary and swinging ornament 15 will be subject to a considerable friction force upon displacing, and the rotary and swinging ornament 15 can only displace along the circumference of magnet 32 without rotating. As shown in FIGS. 5 and 6, the bottom surface 37 of the base member 36 is a spherical surface; when magnet 40 moves automatically to balance the magnetic force, the magnet 40 will be in an oblique state as a result of the spherical surface thereof The lowest bottom point of magnet 40 will almost be in a tangential touch with the inner edge of magnet 32. When the rotary and swinging ornament 15 moves, it will have a lower resistance, and will also generate a waving and turning motion simultaneously.

Referring to a FIGS. 2, 3, 5 and 6 again, when the rotary and swinging ornament 15 is driven with the music drum assembly 12, the ornament 15 on disk 18 will not enter the central part of disk 18 as a result of the repelling force of magnet 31; magnet 32 is fastened on the rotary member 14, moving along a fixed circumference. The center of magnet 32 may be used as a reference center; and magnet 40 being attracted with magnet 32 will move automatically to balance the magnetic force as a result of the repelling force of magnet 31. The final position of magnet 40 attracted by magnet 32 will be in an eccentric state.

Magnet 40 in the base member 36 has a larger diameter, and it will attract with magnet 32 each other to stand in an oblique manner over magnet 32. When magnet 32 on the rotary member 14 turns around spindle 28, magnet 32 will drive magnet 40 to move circularly. The rotary and swinging ornament 15 moves with a low resistance spherical surface, the oblique magnet 40 and the attracting force of magnet 32; by means of the balance effect of magnetic force and the low friction resistance, the spherical bottom surface of the base member 36 will move along a circumference at a suitable diameter.

The ornament body 50 assembled together with the base member 36 is driven with the rotary member 14 to move circularly. The base member 36 has a spherical bottom surface 37 to be in contact with disk 18. By means of the low-resistance spherical contact surface, the rotary and swinging ornament 15 will move in a rolling manner and in an eccentric state so as to have the ornament body 50 on the base member 36 turned along a circumference and also moved in a waving and turning manner; then, the rotary and swinging ornament 15 in the global body 47 of the water globe 16 can also move, turn and swing simultaneously.

What is claimed is:

1. A water globe ornament having a global body filled with liquid and mounted on a base member having a power source located therein, the ornament comprising:

a) a water tight seal mounted to the global body so as to prevent leakage of the liquid therefrom, the water tight seal having an inwardly extending edge portion with an upper surface;

b) a disk having a smooth and flat top surface glued to the water tight seal such that the top surface is substantially flush with the upper surface of the edge portion of the water tight seal;

c) a rotatable spindle located in the base member and rotatably driven by the power source;

d) a frame having an arm plate mounted on the spindle so as to rotate therewith;

e) first and second magnets mounted on the frame adjacent to the disk, the magnets having opposite poles facing the disk, both magnets being mounted eccentrically with respect to an axis of rotation of the spindle such that the magnets travel in different circular paths around the axis of rotation of the spindle;

f) an ornament located in the fluid within the global body, the ornament having a substantially hollow body with a hole through a bottom portion, the ornament being filled with liquid to reduce its buoyancy in the liquid filled global body; and, g) a member mounted on the body and covering the hole, the member having a spherically curved lower surface in contact with the upper surface of the disk, the member having a third magnet mounted thereon such that the third magnet has a pole facing the disk which is the same polarity as the pole facing the disk of the one of the first and second magnets having the smaller circular path, whereby rotation of the frame causes the body to rotate and to swing on the spherically curved surface.

2. The water globe of claim 1 wherein the water tight seal has cylindrical through hole bounded by the edge portion and wherein the disk is located in the through hole.

3. The water globe of claim 2 wherein the edge portion and a peripheral edge of the disk have engaging stepped configurations.

4. The water globe of claim 1 wherein the water tight seal has a recessed section bounded by the edge portion and wherein the disk is located in the recessed section.

5. The water globe of claim 1 further comprising a weight mounted in the member on the ornament body.

* * * * *